US009441320B2

(12) United States Patent
Nitta et al.

(10) Patent No.: US 9,441,320 B2
(45) Date of Patent: Sep. 13, 2016

(54) CLOTH PRESSER FOR HANDICRAFT

(71) Applicant: CLOVER MFG. CO., LTD., Osaka-shi, Osaka (JP)

(72) Inventors: Kumiko Nitta, Osaka (JP); Chihiro Iwasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 2 days.

(21) Appl. No.: 14/510,774

(22) Filed: Oct. 9, 2014

(65) Prior Publication Data

US 2015/0107504 A1 Apr. 23, 2015

(30) Foreign Application Priority Data

Oct. 22, 2013 (JP) ..... 2013-219299

(51) Int. Cl.

| | |
|---|---|
| ***D05B 97/02*** | (2006.01) |
| ***D05B 29/00*** | (2006.01) |
| ***D06F 71/36*** | (2006.01) |
| *D06F 79/00* | (2006.01) |

(52) U.S. Cl.

CPC ..... *D05B 97/02* (2013.01); *D05B 29/00* (2013.01); *D06F 71/36* (2013.01); *D06F 79/00* (2013.01)

(58) Field of Classification Search

CPC ..... A45D 29/00; A45D 29/16; D06F 71/16; D06F 71/02; D06F 71/18; D06F 71/30; D06F 71/36; D06F 87/00; A45G 25/72; D05B 29/00; D05B 92/00; D06F 85/00; D06F 79/00

USPC ..... D28/44.1, 57, 59; D3/18, 28

See application file for complete search history.

(56) References Cited

U.S. PATENT DOCUMENTS

| | | | | | |
|---|---|---|---|---|---|
| 1,112,207 | A | * | 9/1914 | Gibson | A45D 29/04 132/75.6 |
| 1,413,033 | A | * | 4/1922 | Keyser | A45D 29/16 132/75.3 |
| 1,715,914 | A | * | 6/1929 | Halk | A45D 40/28 132/73 |
| 2,035,323 | A | * | 3/1936 | Langdon | A45D 29/16 132/75.3 |
| D116,216 | S | * | 8/1939 | Brekke | 132/73 |
| 2,764,989 | A | * | 10/1956 | Simmons | A45D 29/16 132/75.3 |
| D210,266 | S | * | 2/1968 | Dunne | D3/18 |
| D246,000 | S | * | 10/1977 | Yacos | D28/57 |
| 4,770,195 | A | * | 9/1988 | Dore | A45D 29/16 132/73 |
| 4,886,078 | A | * | 12/1989 | Shiffman | A45D 29/17 132/73 |
| D600,407 | S | * | 9/2009 | Padain | D28/44.1 |

FOREIGN PATENT DOCUMENTS

| | | |
|---|---|---|
| JP | S 777801 | 12/1989 |

* cited by examiner

*Primary Examiner* — Ismael Izaguirre

(74) *Attorney, Agent, or Firm* — Hamre, Schumann, Mueller & Larson, P.C.

(57) ABSTRACT

A cloth presser includes a grip portion, a first press end and a second press end. The grip portion is elongated, having a straight longitudinal axis. The first press end and the second press end are spaced apart from each other, with the grip portion intervening between the first press end and the second press end. The first press end is configured to make point contact with an object such as a piece of cloth, and the second press end is configured to make surface contact with the object.

8 Claims, 7 Drawing Sheets

CLOTH PRESSER FOR HANDICRAFT

BACKGROUND OF THE INVENTION

1. Field of the Invention

The present invention relates to a presser used in handicraft for holding and/or moving, e.g., a sheet-like material such as cloth or fabric.

2. Description of the Related art

Conventionally, use has been made of a cloth presser for moving a piece of cloth being sewn with a sewing machine. For example, JP Design Registration No. 777801 discloses a prick punch that can be used as a cloth presser. The conventional prick punch disclosed in the document includes a metal extension extending from the grip portion. The extension has a sharp-pointed tip.

In use, the cloth is lightly held down with the tip of the extension, and the tip is moved in the desired direction to move the cloth. The tip of the extension, however, tends to slip on the cloth due to the small area of contact, which is not preferable for moving the cloth properly.

SUMMARY OF THE INVENTION

The present invention has been proposed under the circumstances described above. Thus, it is an object of the present invention to provide a suitable presser for cloth or fabric, for example, whereby the use can properly move a sheet-like object in a desired direction.

According to an embodiment of the present invention, there is provided a cloth presser that includes: an elongated grip portion having a straight longitudinal axis; and a first press end and a second press end spaced apart from each other with the grip portion intervening between the first press end and the second press end. The first press end is configured to make point contact with cloth, and the second press end is configured to make surface contact with the cloth.

Preferably, the first press end includes a pointed tip, and the second press end includes a flat surface softer than the first press end.

Preferably, the cloth presser further includes a tapered extension extending from the grip portion. The extension has a curved central axis, and the first press end is provided at an end of the extension.

Preferably, the second press end is slanted with respect to the longitudinal axis of the grip portion, and the second press end is smaller in area than the maximum cross section of the grip portion.

Preferably, the second press end has a normal line contained in a plane containing the central axis of the extension. The second press end faces a region in which the extension is disposed with respect to the longitudinal axis of the grip portion.

Preferably, the cloth presser further includes: a shaft extending from the grip portion in parallel to the longitudinal axis of the grip portion; and a cap attached to the shaft. The shaft is smaller in diameter than the grip portion, the cap has an outer surface connected smoothly to an outer surface of the grip portion, and the second presser end is disposed at the cap.

Preferably, the cap is formed with a hole into which the shaft is fitted, the shaft includes an inclined end surface generally parallel to the second press end, and the hole includes a bottom surface configured to make surface contact with the inclined end surface.

Preferably, the grip portion, the extension and the shaft are made of a first resin, and the cap is made of a second resin that is softer than the first resin.

Preferably, the first resin and the second resin are a thermosetting resin.

Other features and advantages of the present invention will become more apparent from detailed description given below with respect to the accompanying drawings.

DETAILED DESCRIPTION OF THE PREFERRED EMBODIMENTS

Preferred embodiments of the present invention will be described below with reference to the accompanying drawings.

Figure 1:
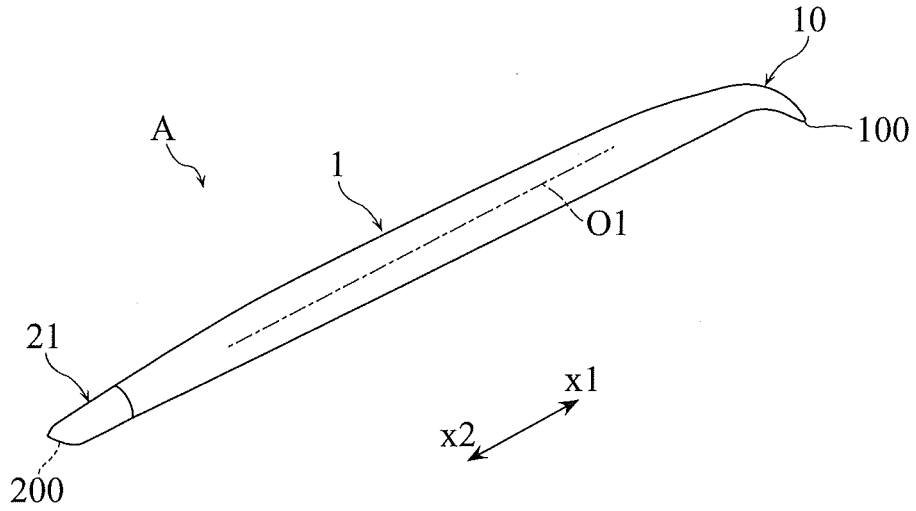
FIG. 1 is a perspective view depicting a cloth presser according to an embodiment of the present invention.
Figure 2:
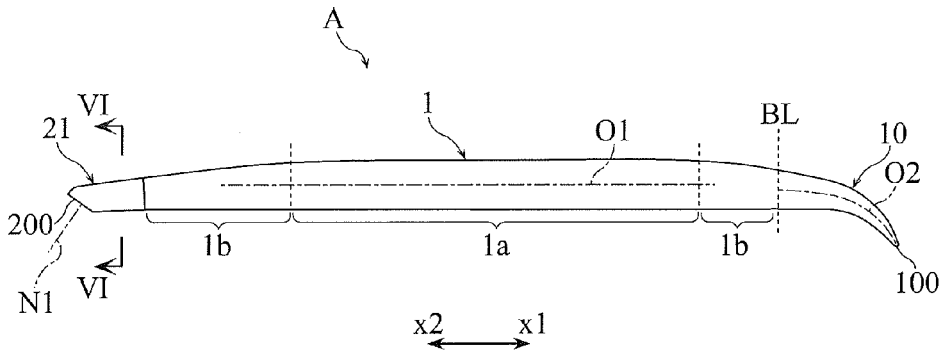
FIG. 2 is a front view of the presser shown in FIG. 1.
Figure 3:
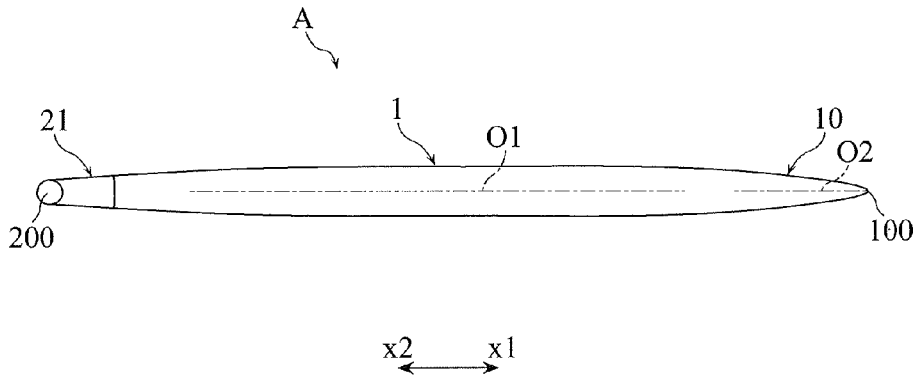
FIG. 3 is a bottom view of the presser shown in FIG. 1.

FIGS. 1-7 depict a cloth presser according to an embodiment of the present invention. As shown in FIGS. 1-3, the illustrated cloth presser A includes an elongated grip portion 1 and a first press end 100 and a second press end 200. The first press end 100 and the second press end 200 are spaced apart from each other in the x1-x2 direction ("longitudinal direction"), with the grip portion 1 intervening between these two ends.

The grip portion 1 is a bar-shaped member made of e.g., a hard thermosetting resin, and has a straight axis O1 extending in the x1-x2 direction. The grip portion 1 is the part to be gripped by a user, and has a circular cross section over its entire length. Along the x1-x2 direction, the grip portion 1 includes a central part 1*a* (whose cross-sectional area is constant) and two end parts 1*b* connected to the central part 1*a* at its respective ends. Each end part 1*b* is configured to taper with increasing distance from the central part 1*a*. It should be noted that the present invention is not limited to such an arrangement. The grip portion 1 may be configured to have a non-constant cross-sectional area. In this instance, the grip portion 1 may be tapered from the longitudinal center toward the respective ends.

The first press end 100 is spaced apart from the grip portion 1 in the x1 direction, and is formed as a hard, sharp-pointed tip. As readily seen, the first press end 100 is capable of making point contact with a piece of cloth, for example. The second press end 200 is spaced apart from the grip portion 1 in the x2 direction, and is formed as a relatively soft, flat surface. Thus, the second press end 200 is capable of making surface contact with a piece of cloth, for example. In other words, the second press end 200 has a greater contact area than the first press end 100.

As seen from FIG. 2, the second press end 200 is slanted with respect to the longitudinal axis O1 of the grip portion 1 (or to a plane perpendicular to the longitudinal axis O1). The second press end 200 is formed at the tip of the cap 21. The inclination of the second press end 200 with respect to the longitudinal axis O1 is arranged so that the angle (greater than 0° and smaller than 90°) formed between the normal line N1 of the second press end 200 and the longitudinal axis O1 is, for example, 45°.

As shown in FIGS. 2 and 3, an extension 10 is formed integral with the right end of the grip portion 1. In FIG. 2, the border between the grip portion 1 and the extension 10 is indicated by a broken line BL (perpendicular to the longitudinal axis O1). As readily seen, such a border between the grip portion 1 and the extension 10 cannot necessarily be determined definitely, and the illustrated broken line BL is provided only for the purposes of explaining the structure of the presser A.

The extension 10 has a curved central axis O2. The extension 10 is configured to taper along the central axis O2 with increasing distance from the grip portion 1. The extension 10 is made of the same hard thermosetting resin as the grip portion 1. The first press end 100 is formed at the tip of the extension 10.

Figure 5:
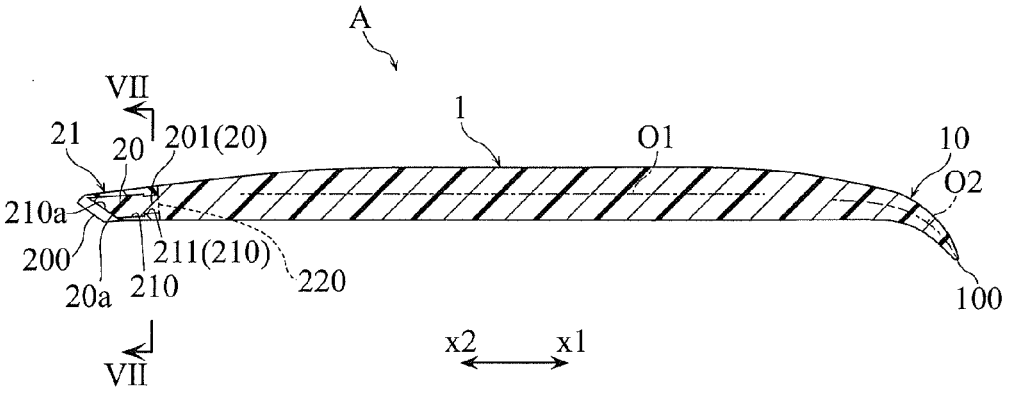
FIG. 5 is a sectional view taken along V-V line in FIG. 4.
Figure 6:
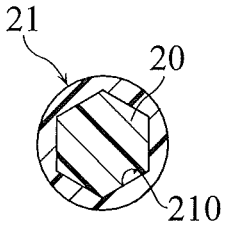
FIG. 6 is a sectional view taken along VI-VI line in FIG. 2.

As shown in FIG. 5, a shaft 20 is formed integral with the left end of the grip portion 1. The shaft 20 extends from the grip portion 1 in the x2 direction. As shown in FIG. 6, the cross section of the shaft 20 is in the form of a polygon (in the illustrated example, a hexagon). As shown in FIG. 5, the shaft 20 has a base end (adjacent to the grip portion 1), and the base end is formed with a small-diameter portion 201 that has a smaller cross-sectional area than adjacent portions. The tip of the shaft 20 (i.e., the end spaced apart from the grip portion 1) is formed with an inclined surface 20*a* slanted with respect to the cross section of the shaft 20 (or the longitudinal axis O1 of the grip portion 1).

The above-mentioned grip portion 1, extension 10 and shaft 20 are formed integral with each other with a hard thermosetting resin. Examples of such a thermosetting resin are melamine resin and an urea formaldehyde resin.

As shown in FIG. 5, a cap 21 is configured to cover the shaft 20. The cap 21 is formed with a bottomed hole 210 extending in parallel to the longitudinal axis O1. As shown in FIG. 6, the cross section of the hole 210 has the same polygonal shape as that of the shaft 20 (in the illustrated example, hexagonal). The hole 210 is provided with a circular engagement portion 211 adjacent to the open end of the hole. The cross-sectional area of the hole 210 becomes relatively small where the engagement portion 21 is provided. The hole 210 has a bottom surface 201*a* which is slanted with respect to the cross section of the hole or to the longitudinal axis O1 of the grip portion 1. The second press end 200 is formed at the tip of the cap 21.

The cap 21 is made of a thermosetting resin which is softer than the hard thermosetting resin mentioned above. An example of such a soft thermosetting resin is a thermosetting elastomer that exhibits rubber-like elasticity. Alternatively, use may be made of silicone rubber, (poly)urethane rubber or fluorocarbon rubber.

The cap 21 is detachably attached to the shaft 20. As shown in FIG. 5, the shaft 20 is fitted into the hole 210 via the aperture 220 of the cap 21. The outer peripheral surface of the cap 21 connects smoothly (i.e., without a step) to the outer peripheral surface of the grip portion 1. The cap 21 tapers toward its tip, that is, its cross-sectional area becomes smaller as proceeding toward the tip (see also FIGS. 2 and 3). In the illustrated example, the area of the second press end 200 is large enough to prevent the second press end 200 from slipping on the cloth when the user wants to move the cloth. In the illustrated example (see FIG. 5), the area of the second press end 200 is smaller than the maximum cross sectional area of the grip portion 1 (i.e., the cross sectional area of the central part 1*a*). It should be noted that the invention is not limited to such arrangements. For instance, the area of the second press end 200 may be smaller than any other threshold.

Figure 7:
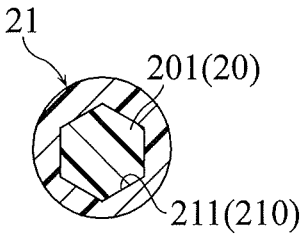
FIG. 7 is a sectional view taken along VII-VII line in FIG. 5.

As shown in FIG. 5, with the cap 21 attached properly, the second press end 200 and the inclined surface 20*a* of the shaft 20 are parallel (or substantially parallel) to each other, and thus the inclined surface 20*a* and the bottom surface 210*a* make surface contact with each other. Also, as shown in FIG. 6, the outer peripheral surface of the shaft 20 and the hole 210 are in surface contact with each other. Further, as shown in FIG. 7, the outer peripheral surface of the small-diameter portion 201 and the circular engagement portion 211 are in surface contact with each other.

Figure 4:
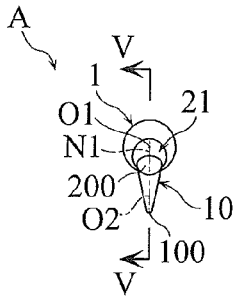
FIG. 4 is a left side view of the presser shown in FIG. 1.

As seen from FIGS. 2-4, with the cap 21 attached properly, the central axis O2 of the extension 10 and the normal line N1 of the second press end 200 are contained in the same plane. In FIG. 2, the above-noted plane can be divided into the upper half and the lower half with respect to the longitudinal axis O1 of the grip portion 1. In this instance, the first press end 100 (and at least a part of the extension 10) is located in the lower half of the plane. Further, the outward normal line N1 of the second press end 200 extends in the lower half of the plane. That is, the second press end 200 faces to a region in which the extension 10 is located with respect to the longitudinal axis O1.

A method of how to use the cloth presser A and its advantages will be described with reference to FIGS. 8-10.

The cloth presser A is provided with the first press end 100 and the second press end 200 that are spaced from each other in the longitudinal direction of the grip portion 1. The first press end 100 is configured to hold the cloth by point contact, while the second press end 200 is configured to hold the cloth by surface contact. Either of the first press end 100 and the second press end 200 can be selected for use, depending on the situation as described below.

Figure 8:
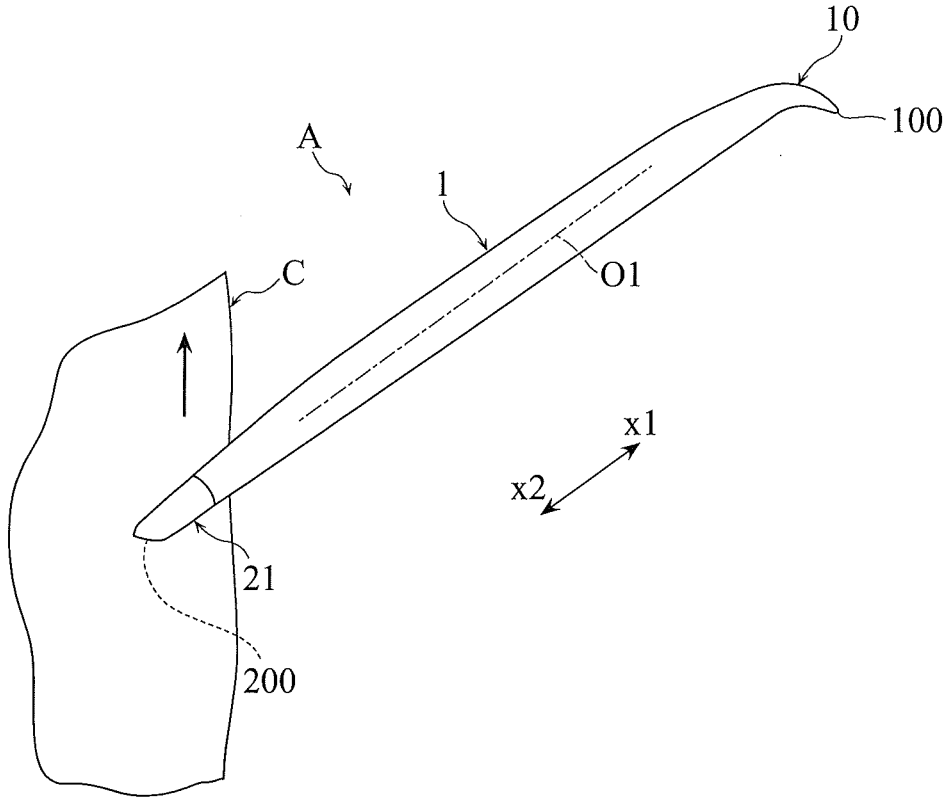
FIG. 8 is a perspective view illustrating an example of how to use the presser shown in FIG. 1.

In use, the user may hold the grip portion 1, and as shown in FIG. 8, the second press end 200 is pressed against the cloth C. The second press end 200 is a flat surface, which is advantageous to preventing the second press end 200 from slipping on the cloth C. Thus, the second press end 200 can be conveniently used for moving the cloth C in a desired direction.

The second press end 200 is slanted to the longitudinal axis O1 of the grip portion 1. As a result, the grip portion 1 inclines at a suitable angle to the vertical direction when the second press end 200 is pressed onto the cloth C. Hence, it is convenient for the user to hold the grip portion 1.

The cap 21 is configured to taper, and the second press end 200 is provided at the tip of the cap 21. With such an arrangement, the user can readily recognize the position of the second press end 200 when using the presser, and hence bring the second press end 200 to a desired part of the cloth C accurately. Since the cap 21 is made of a relatively soft resin, the second press end 200 is soft. Accordingly, the frictional force generated between the cloth C and the second press end 200 is great enough to move the cloth C as required.

The cap 21 is attached to the shaft 20 by fitting the shaft 20 into the hole 210. As shown in FIG. 5, the second press end 200 is parallel to the inclined surface 20*a* of the shaft 20. Thus, the inclined surface 20*a* makes surface contact with the bottom surface 210*a* of the hole 210. With this arrangement, the second press end 200 can be backed up by the inclined surface 20*a* when the second press end 200 is pressed onto the cloth C.

The cross section of the shaft 20 and the cross section of the hole 210 have the same polygonal shape. Thus, the outer peripheral surface of the shaft 20 makes surface contact with the hole 210, and it is easy to position the cap 21 about the shaft 20. The cap 21 does not unduly turn about the shaft 20 once they are positioned relative to each other around the axis of the shaft 20. In the illustrated example, the small-diameter portion 201 of the shaft 20 and the circular engagement portion 211 of the cap 21 come into engagement with each other. Thus, the cap 21 does not come off the shaft 20 unduly.

Figure 9:
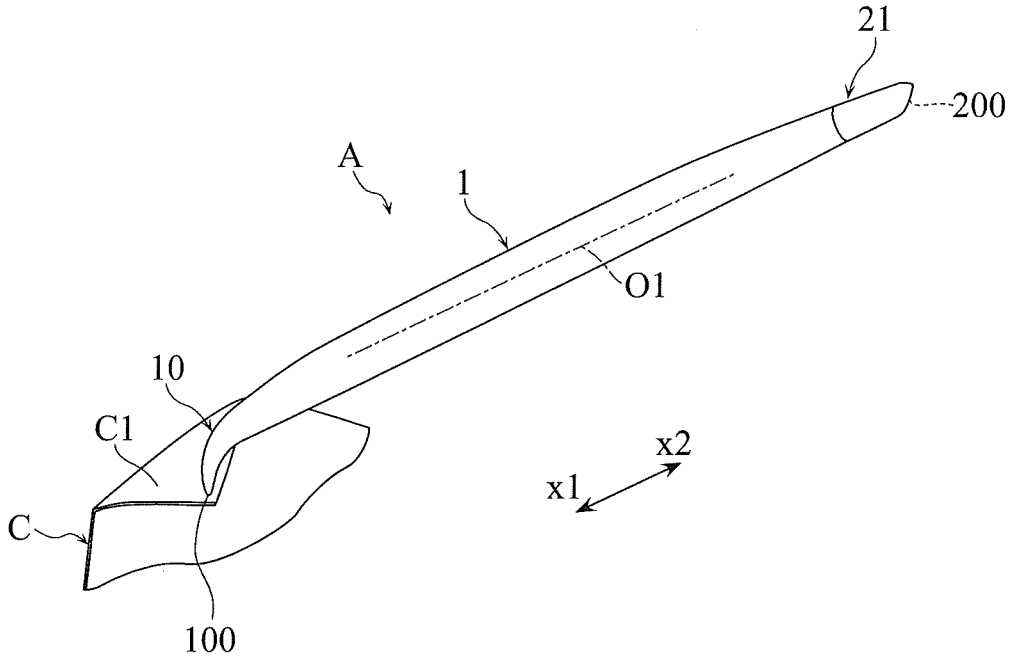
FIG. 9 is a perspective view illustrating an example of how to use the presser shown in FIG. 1.

In use of the cloth presser A, the first press end 100 can be used, as shown in FIG. 9, to hold a turn-up C1 of the cloth C. In this manner, the ironing to the turn-up C1 can be performed more safely than when the turn-up is held with a finger of the user. Since the first press end 100 is in the form of a hard tip, it can properly hold the turn-up C1 even when the turn-up C1 is very small.

The extension 10 is made of a thermosetting resin. Thus, the extension 10 (hence the first press end 100) offers excellent resistance to high temperatures. The extension 10 extends from the grip portion 1 along the curved central axis O2. With this arrangement, the grip portion 1 inclines when the cloth is held with the first press end 100, whereby the user can comfortably hold the grip portion 1. Also, as shown in FIG. 9, the grip portion 1 is located away from the turn-up C1 (the part to be ironed), which is advantageous to preventing the user's hand from accidentally touching the iron.

Figure 10:
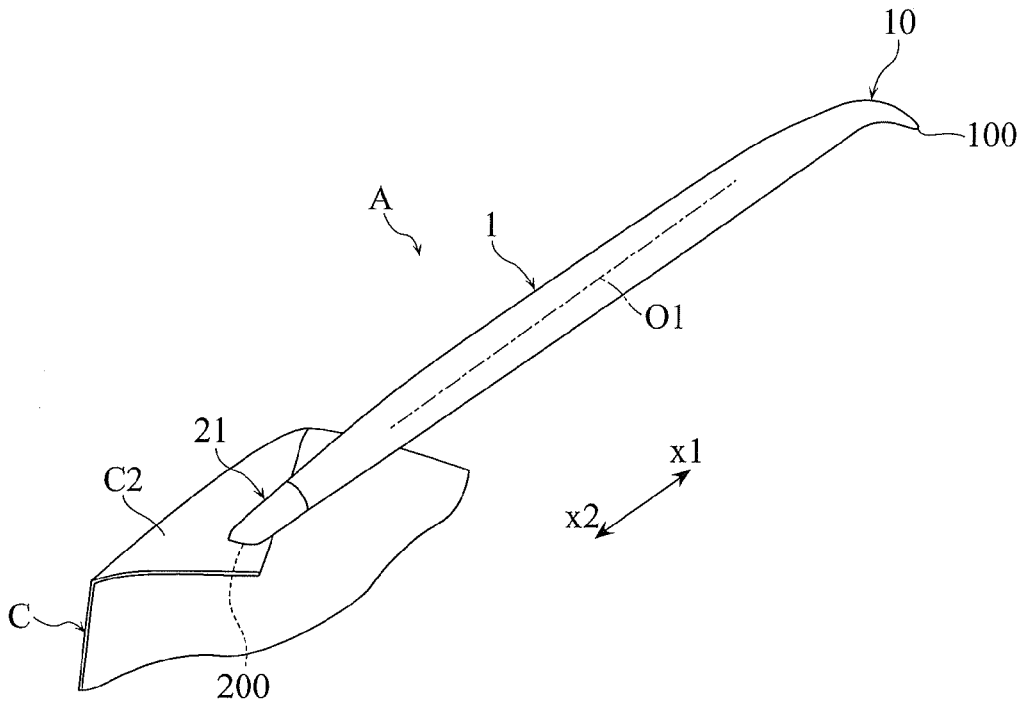
FIG. 10 is a perspective view illustrating an example of how to use the presser shown in FIG. 1.

FIG. 10 shows a turn-up C2 held with the second press end 200. For example, when the turn-up C2 is relatively large, the second press end 200 can be conveniently used to hold the turn-up C2. Since the cap 21 (hence the second press end 200) is made of a thermosetting resin, the cap 21 offers excellent resistance to high temperatures. Thus, it causes no problem when the heated iron accidentally touches the cap 21.

As shown in FIG. 2, the second press end 200 faces obliquely downward, and the extension 10 is configured to curve downward. With this arrangements, as seen from FIGS. 8 and 10, the extension 10 is positioned generally horizontally or obliquely downward when the second press end 200 is pressed onto the cloth C. Hence, the user of the cloth presser A is prevented from being hurt by the sharp-pointed first press end 100.

While a preferred embodiment of the present invention has been described using specific terms, such description is for illustrating purposes only, and it is to be understood that changes and variations may be made without departing from the spirit or scope of the following claims.

The invention claimed is:

1. A cloth presser comprising:

an elongated grip portion having a straight longitudinal axis;

a first press end and a second press end spaced apart from each other with the grip portion intervening between the first press end and the second press end;

a shaft extending from the grip portion in parallel to the longitudinal axis of the grip portion, the shaft being smaller in diameter than the grip portion; and a cap attached to the shaft, wherein the first press end is configured to make point contact with cloth, and the second press end is configured to make surface contact with the cloth, the second presser end is disposed at the cap, and the cap is formed with a hole into which the shaft is fitted, the shaft includes an inclined end surface generally parallel to the second press end, and the hole includes a bottom surface that makes surface contact with the inclined end surface.

2. The cloth presser according to claim 1, wherein the first press end includes a pointed tip, and the second press end includes a flat surface softer than the first press end.

3. The cloth presser according to claim 1, further comprising a tapered extension extending from the grip portion, wherein the extension has a curved central axis, and the first press end is provided at an end of the extension.

4. The cloth presser according to claim 3, wherein the second press end has a normal line contained in a plane containing the central axis of the extension, and wherein the second press end faces a region in which the extension is disposed with respect to the longitudinal axis of the grip portion.

5. The cloth presser according to claim 3, wherein the grip portion, the extension and the shaft are made of a first resin, and the cap is made of a second resin that is softer than the first resin.

6. The cloth presser according to claim 5, wherein the first resin and the second resin are a thermosetting resin.

7. The cloth presser according to claim 1, wherein the second press end is slanted with respect to the longitudinal axis, and the second press end is smaller in area than a maximum cross section of the grip portion.

8. The cloth presser according to claim 7, wherein, the cap has an outer surface connected smoothly to an outer surface of the grip portion.

* * * * *